US007001325B2

(12) United States Patent
Henriksson et al.

(10) Patent No.: US 7,001,325 B2
(45) Date of Patent: Feb. 21, 2006

(54) CENTRIFUGAL SEPARATOR HAVING WHISTLE-REDUCING ROTOR

(75) Inventors: Roland Henriksson, Stockholm (SE); Stefan Szepessy, Huddinge (SE)

(73) Assignee: Alfa Laval Corporate AB, Lund (SE)

( * ) Notice: Subject to any disclaimer, the term of this patent is extended or adjusted under 35 U.S.C. 154(b) by 189 days.

(21) Appl. No.: 10/416,645

(22) PCT Filed: Nov. 8, 2001

(86) PCT No.: PCT/SE01/02538

§ 371 (c)(1),
(2), (4) Date: May 14, 2003

(87) PCT Pub. No.: WO02/40176

PCT Pub. Date: May 23, 2002

(65) Prior Publication Data

US 2004/0029698 A1 Feb. 12, 2004

(30) Foreign Application Priority Data

Nov. 14, 2000 (SE) ..... 0004162

(51) Int. Cl.
*B04B 1/08* (2006.01)
*B04B 7/08* (2006.01)

(52) U.S. Cl. ..... 494/70

(58) Field of Classification Search ..... 494/2–4, 494/40, 56, 68–73, 47–48, 82, 80, 60
See application file for complete search history.

(56) References Cited

U.S. PATENT DOCUMENTS

| | | | | |
|---|---|---|---|---|
| 1,882,389 | A * | 10/1932 | MacIsaac | 494/56 |
| 4,410,318 | A * | 10/1983 | Bjork et al. | 494/82 |
| 4,820,257 | A * | 4/1989 | Ishimaru | 494/16 |
| 5,202,024 | A * | 4/1993 | Andersson et al. | 494/70 |
| 5,916,083 | A * | 6/1999 | Bjorkstrom | 494/56 |
| 2004/0029698 | A1 * | 2/2004 | Henriksson et al. | 494/70 |

FOREIGN PATENT DOCUMENTS

| | | |
|---|---|---|
| DE | 3409068 A1 * | 9/1985 |
| SE | 463 903 | 2/1991 |
| SE | 505 385 | 8/1997 |

* cited by examiner

*Primary Examiner*—Charles E. Cooley
(74) *Attorney, Agent, or Firm*—Michaud-Duffy Group LLP

(57) ABSTRACT

A centrifugal separator has a centrifuge rotor and a casing, the casing forming an outer space for the rotor. The rotor is rotatable around a rotary axis and within the casing. The rotor includes a rotor wall, which defines an outer periphery of the rotor and encloses an inner space, an inlet, which extends through the rotor wall and permits feeding of a product to the inner space, and a number of outlets, which extend through the rotor wall and are arranged to permit intermittent discharge of a separated product from the inner space to the outer space. The outlets are distributed around the periphery of the rotor. The number of outlets is uneven, and a valve member extends around the rotor wall to define a space between the wall and the valve member at the level of the outlets.

11 Claims, 5 Drawing Sheets

CENTRIFUGAL SEPARATOR HAVING WHISTLE-REDUCING ROTOR

CROSS-REFERENCE TO RELATED APPLICATIONS

This application is entitled to the benefit of and incorporates by reference essential subject matter disclosed in International Application No. PCT/SE01/02538 filed on Nov. 8, 2001 and Swedish Patent Application No. 0004162-4 filed on Nov. 14, 2000.

THE BACKGROUND OF THE INVENTION AND PRIOR ART

In general, a centrifugal separator, includes a rotor, which is rotatable around a rotary axis, and a casing, which forms an outer space for the rotatable rotor. The rotor includes a rotor wall, which defines an outer periphery of the rotor and encloses, an inner space, at least an inlet, which extends through the rotor wall and permits feeding of a product to the inner space, and a number of outlets, which extend through the rotor wall and are arranged to permit intermittent discharge of a separated product from the inner space to the outer space. The outlets are distributed around the periphery of the rotor.

During operation of such a centrifugal separator, sounds are generated, and more precisely, the rotor may whistle, i.e. sound generated in cavities of the rotor. The sound level of such whistle may sometimes be unacceptably high and exceed the level of structural sounds from other sound sources of the centrifugal separator, for instance from turbulent pressure fluctuations in said outer space and internally in the rotor, and from the transmission and the motor.

Whistle arises in the cavities in the rotor wall, which are formed by said outlets, due to the fact that the cavities, which enclose a gas volume, have a velocity in relation to the gas, which is located outside the cavities in said outer space. Whistle is excited by this gas, normally air, when it passes the orifices of the cavities towards the outer space and causes the gas located in the cavity to vibrate. The whistle tendency increases generally with an increasing rotary speed of the rotor.

There is a relation between the presence of whistle and the geometry of the cavities, and more precisely the frequency of such whistle is determined by the shape and dimensions of the cavities. Whistle may thus be limited by a change of this geometry. The possibilities of making such geometrical changes are limited by the strength requirements, which are set up for the material portions, which are present between adjacent cavities and which connect an upper part of the rotor to a lower part thereof.

SE-B-463 903 discloses such a centrifugal separator. The centrifuge rotor includes a number of outlets, which extend through the rotor wall for discharging a separated product from the inner space of the rotor to an outer space outside the rotor. The outlets are evenly distributed around the periphery of the rotor. In order to disturb the formation of sound waves in the outlets, projections in the form of elongated ribs are provided between the outlets.

SE-C-505 385 discloses a similar centrifugal separator with a rotor having a number of outlets, which are evenly distributed around the periphery of the rotor. In this document, a geometrical change of said outlets are proposed in order to provide a reduction of the generated sound level.

More precisely, outlets are disclosed, which have a decreasing cross-section area from the outer side of the rotor wall to a position between the outer side and the inner side.

SUMMARY OF THE INVENTION

The object of the present invention is to reduce the sound level during operation of a centrifugal separator, and in particular to reduce whistle from the centrifuge rotor.

This object is obtained by the centrifugal separator initially defined, which is characterised in that the number of outlets is uneven.

The applicant has shown that there is an acoustic coupling in the peripheral direction of the rotor between the eigenmodes, i.e. whistle tunes, which are generated in the different outlets. By providing the rotor with an uneven number of outlets, this coupling will be disturbed. The energy in the eigenmodes, which have such a coupling to the adjacent outlets that the acoustic natural vibration has nodal points between the outlets and phase-shifted anti node in every second outlet, will be weakened and thus the sound excitation is also reduced. Suitable number of uneven outlets may be a prime number or at least 5 or at the most 17 outlets, preferably at least 7 and at most 15 outlets, or more preferably at least 9 outlets and at most 13 outlets. Especially, the rotor may include 11 outlets.

According to an embodiment of the invention, the rotor includes a valve member, which is provided inside said outlets and arranged to be in a closed position, in which said discharge is prevented, and in an opened position, respectively, in which said discharge is permitted. In that connection, the valve member may, in the closed position, extend around the rotor wall in such a manner that a gap-like space is formed between the rotor wall and the valve member at the level of said outlets.

According to a further embodiment of the invention, the separator is arranged to rotate the rotor at a rotary speed of at least 3000 rpm (revolutions per minute), preferably at least 4000 rpm and more preferably at least 5000 rpm.

According to a further embodiment of the invention, each outlet forms a cavity through the rotor wall, wherein each cavity has a main direction extending outwardly with regard to said rotary axis and rearwardly with regard to said rotary direction. Such a shape of the cavity is advantageous for an efficient, intermittent discharge of the separated product. The intermittent discharge takes place during a relatively short period of time. During the main time of the operation of the centrifugal separator when no such discharge does take place, a gas, which is relatively still standing in relation to the rotor, will be present in the cavity. Each such cavity may with regard to said rotary axis have an upper limiting wall and a lower limiting wall, which walls are substantially parallel to each other and to a radial plane. Advantageously, said outlets may be produced by milling.

According to a further embodiment of the invention, said outlets are evenly distributed around the periphery of the rotor. Furthermore, said outlets may be distributed around the periphery of the rotor at substantially the same axial position with regard to said rotary axis and be substantially identical.

The object is also obtained by the centrifuge rotor initially defined, which is characterised in that said number of outlets are uneven.

BRIEF DESCRIPTION OF THE DRAWINGS

The present invention is now to be described more closely by a description of various embodiments, disclosed as examples, and with reference to the drawings attached, in which FIG. 1 discloses schematically a partly sectional side view of a part of a centrifugal separator according to the invention, FIG. 2 discloses an axial section through a rotor of the centrifugal separator in FIG. 1, FIG. 3 discloses a radial section along the line III—III in FIG. 2, FIG. 4 discloses a diagram of the sound level of a centrifuge rotor with 11 outlets, and FIG. 5 discloses a diagram of the sound level of a previously known centrifuge rotor with 12 outlets.

DETAILED DESCRIPTION OF VARIOUS EMBODIMENTS OF THE INVENTION

Figure 1:
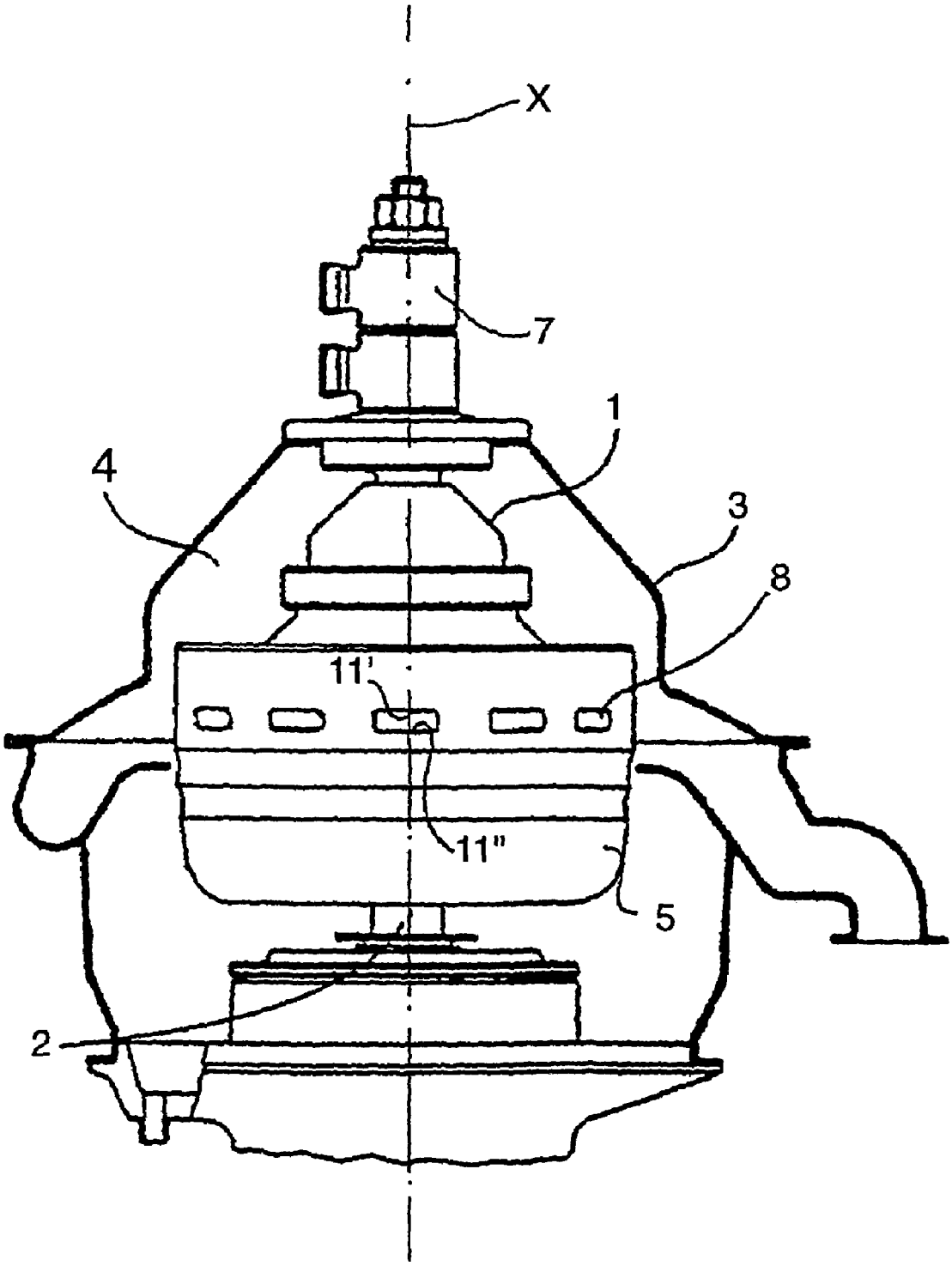

FIG. 1 discloses a centrifugal separator including a centrifuge rotor 1, which in the following is called the rotor 1 and which is carried by a substantially vertical spindle 2. The spindle 2 with the rotor 1 is rotatable in a rotary direction d, see FIG. 3, about a rotary axis x. Furthermore, the centrifugal separator includes a substantially stationary frame, which is illustrated by and includes a casing 3 forming an outer, gas-containing space 4 for the rotor 1.

The spindle 2 is journalled in said frame by means of an upper bearing and a lower bearing, not shown. Furthermore, the spindle 2 is connected to a drive member, not shown, which is arranged to rotate the rotor 1 at a high rotary speed of between 3000 and 5000 rpm (revolutions per minute), for instance at least 3400, at least 3800, at least 4900, at least 4400 or at least 4800 rpm.

Figure 2:
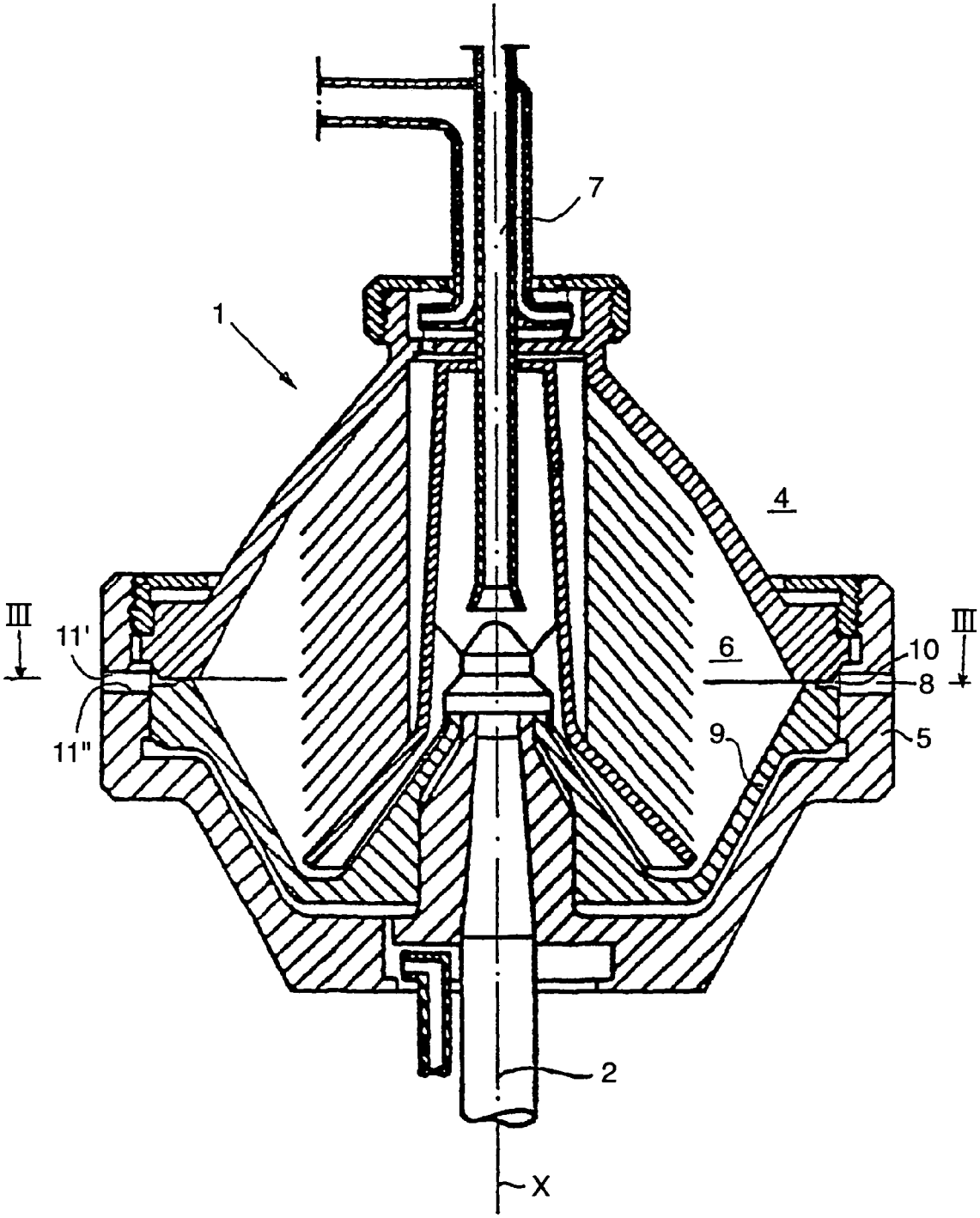

The rotor 1 includes a rotor wall 5, which defines an outer periphery of the rotor 1 and encloses an inner space 6 in the rotor 1. In the inner space 6, there are components known per se as being indicated in FIG. 2. Furthermore, the rotor I includes an inlet 7, which includes an inlet pipe extending substantially vertically through the rotor wall 5 to a central position in the inner space 6, and which permits feeding of a product to the inner space 6. The rotor 1 also has a number of outlets 8, which extend through the rotor wall 5 and are arranged to permit intermittent discharge of a separated product from the inner space 6 to the outer space 4.

The rotor 1 includes a substantially circular, bowl-shaped valve member 9, which is provided in the inner space 6 inside the outlets 8. The intermittent discharge is obtained by means of the valve member 9, which is arranged to take one of two possible positions, i.e. a closed position, in which the discharge of the separated product is prevented, and an opened position, respectively, in which such discharge is permitted, normally during a very short period of time in relation to the time period during which the valve member 9 is closed. The valve member 9 extends in the closed position around the inner side of the rotor wall 5 in such a way that a gap-like space 10 is formed between the rotor wall 5 and the valve member 9 at the level of said outlets 8.

Each outlet 8 forms a cavity 11, which extends through the rotor wall 5. Each such cavity 11 has a main direction, which extends outwardly with regard to the rotary axis x and rearwardly with regard to the rotary direction d. Each such cavity 11 has, with regard to the rotary axis x, a first, upper, substantially plane limiting wall 11' and a second, lower, substantially plane liming wall 11", which are connected to each other by curved side walls. The limiting walls 11' and 11" are substantially parallel to each other and to a radial plane. The outlets 8 are produced by milling.

The outlets 8 are evenly distributed around the periphery of the rotor 1, i.e. the distance between adjacent outlets 8 is constant around the periphery of the rotor 1. Furthermore, the outlets 8 are distributed around the periphery of the rotor at the same level, i.e. at the same axial position with regard to the rotary axis x. All the outlets 8 are also substantially identical.

The cavities 11 of the outlets 8 will during operation, and when the valve member 9 is in the closed position, thus enclose a gas, preferably air, which is substantially still standing in relation to the rotor 1. This gas volume will be brought to vibration by the shear layer, which is formed in the outer space 4 most closely to the outer side of the rotor wall 5 and which has a high speed in relation to the gas volume in the cavities 11. Since the geometrical shape of the different cavities 11 is identical, the generated eigenmodes will be substantially equal and propagate acoustically via the adjacent spaces, in particular via the gap-like space 10 with nodal points in the different cavities 11.

Figure 3:
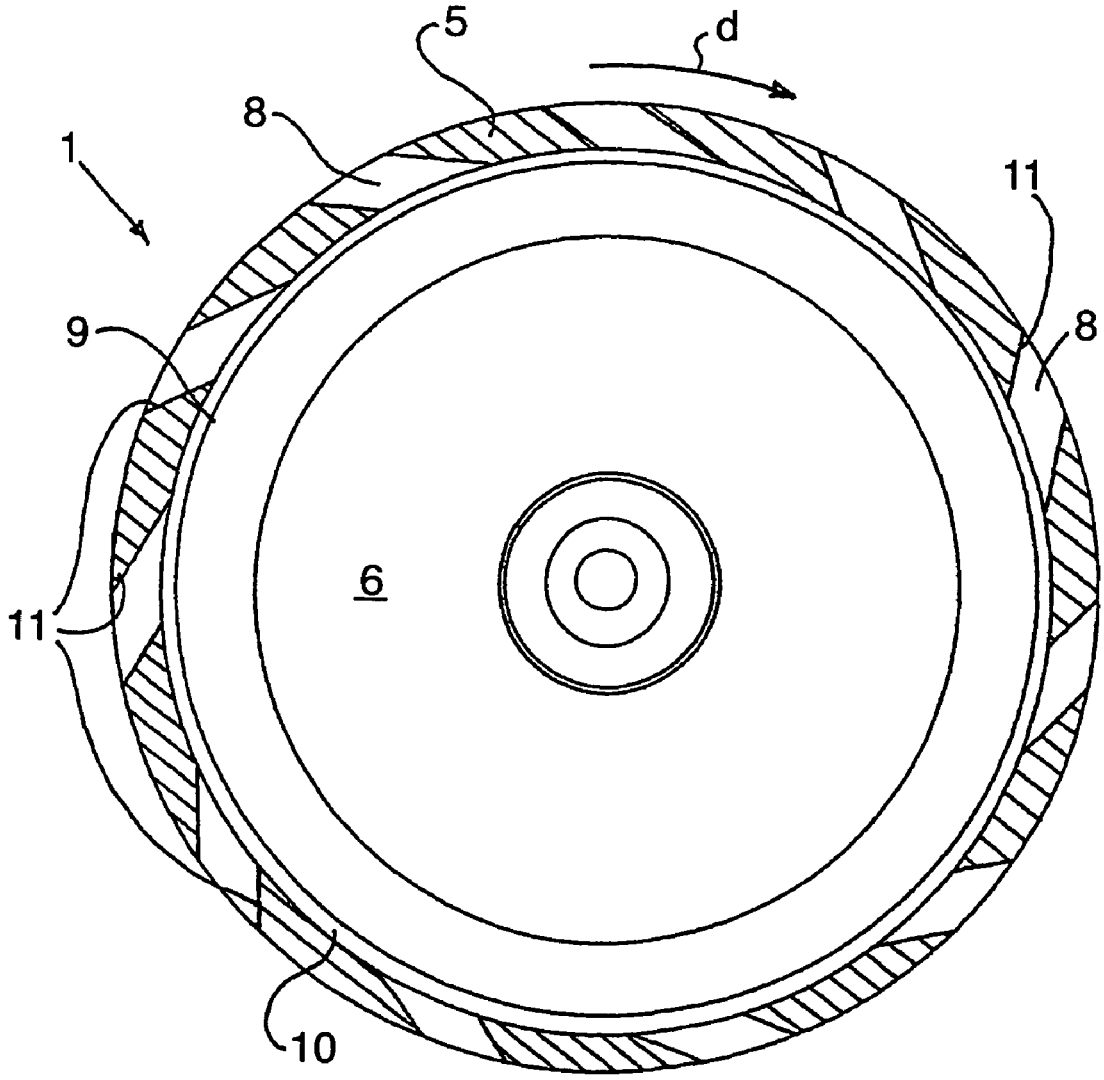

As appears from FIG. 3, the rotor 1 has an uneven number of outlets 8 and cavities 11. In the embodiment disclosed, the rotor 1 is provided with 11 such outlets 8. According to the invention, the rotor may also have 3, 5, 7, 9, 13, 15, 17, 19 or a larger number of uneven outlets 8. Thanks to the uneven number of outlets 8, such an acoustic propagation of the generated eigenmodes will be prevented.

Figure 4:
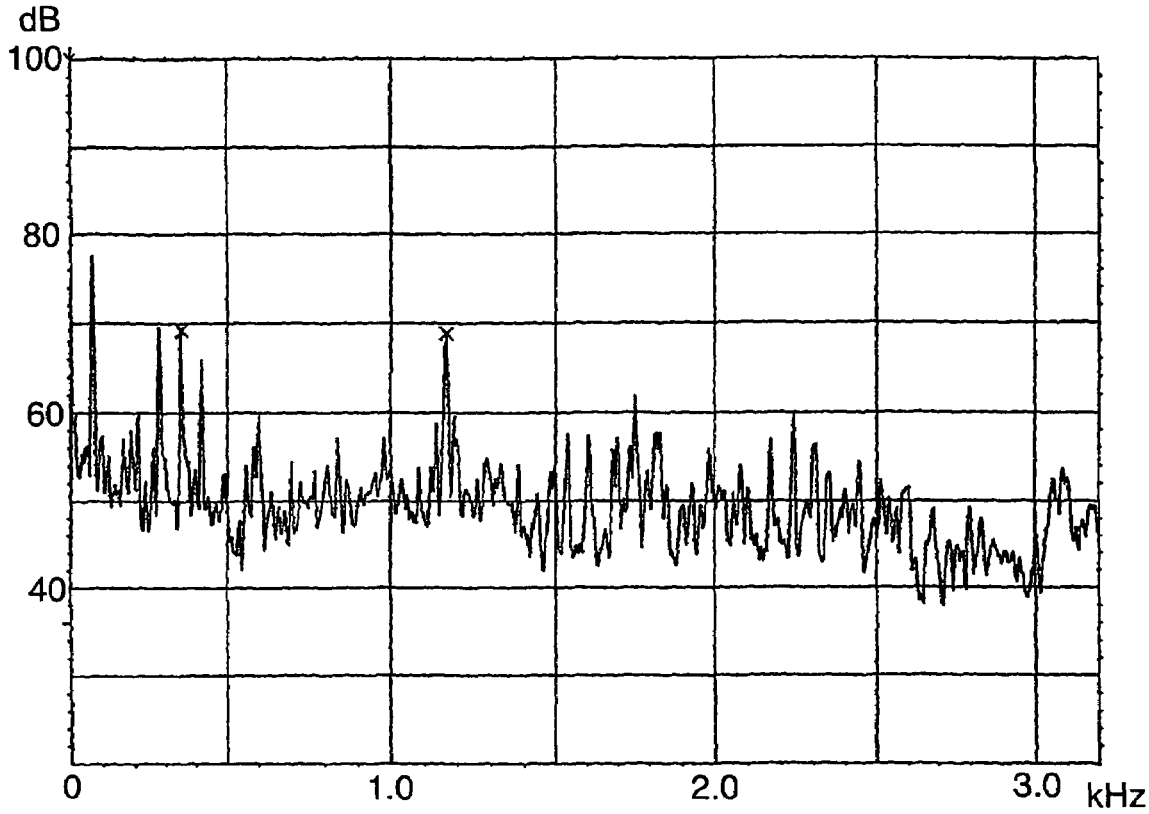
Figure 5:
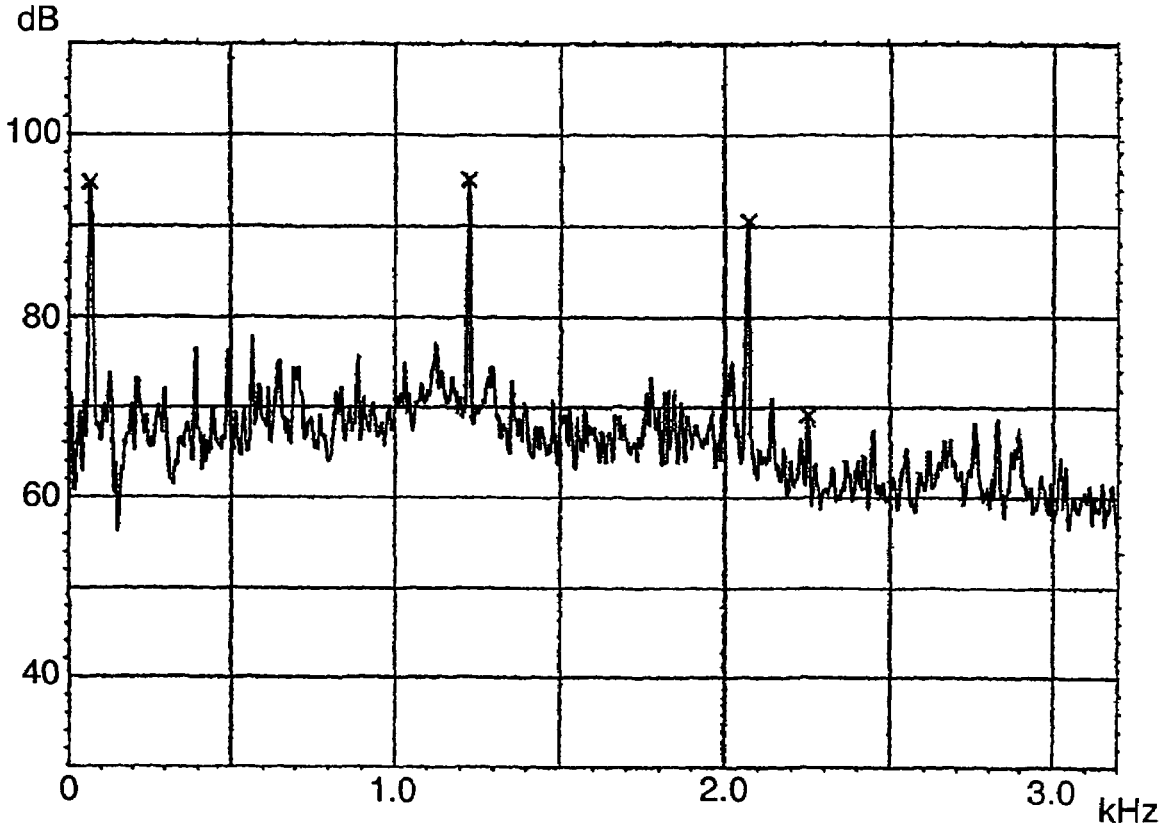

The applicant has performed comparing trials at a rotary velocity of 4265 rpm with a centrifuge rotor, which includes an uneven number of outlets 8, and more precisely 11 outlets, see FIG. 4, and a previously known centrifuge rotor, which includes 12 outlets, see FIG. 5. As appears from FIGS. 4 and 5, the sound level is lower for the centrifuge rotor with 11 outlets for substantially all frequencies within the frequency range from 0 to 3 kHz.

The invention is not limited to the embodiment disclosed but may be varied and modified within the scope of the following claims. In particular, it is to be noted that the invention is not limited to the disclosed shape of the outlets 8 but these may be shaped in a variety of different manners.

What is claimed is:

1. A centrifugal separator including a centrifuge rotor, rotatable in a rotary direction around a rotary axis, and a casing, which forms an outer space for the rotatable rotor, wherein the rotor includes a rotor wall, which defines an outer periphery of the rotor and encloses an inner space, at least an inlet, which extends through the rotor wall and permits feeding of a product to the inner space, and a number of outlets, which extend through the rotor wall and are arranged to permit intermittent discharge of a separated product from the inner space to the outer space, wherein said outlets are distributed around the periphery of the rotor, said number of outlets being uneven;

wherein the rotor includes a valve member, which is provided inside said outlets and arranged to be in a closed position, in which said discharge is prevented, and in an open position, respectively, in which said discharge is permitted;

wherein the valve member in the closed position extends around the rotor wall in such a way that a gap-like space is formed between the rotor wall and the valve member at the level of said outlets.

2. A centrifugal separator according to claim 1, wherein the centrifugal separator is arranged to rotate the rotor at a rotary speed of at least 3000 rpm.

3. A centrifugal separator according to claim 1, wherein the centrifugal separator is arranged to rotate the rotor at a rotary speed of at least 4000 rpm.

4. A centrifugal separator according to claim 1, wherein the centrifugal separator is arranged to rotate the rotor at a rotary speed of at least 5000 rpm.

5. A centrifugal separator according to claim 1, wherein each outlet forms a cavity through the rotor wall, wherein each cavity has a main direction extending outwardly with regard to said rotary axis and rearwardly with regard to said rotary direction.

6. A centrifugal separator according to claim 5, wherein each cavity with regard to said rotary axis has a first limiting wall and a second limiting wall, which walls are substantially parallel to each other and to a radial plane.

7. A centrifugal separator according to claim 6, wherein said outlets are produced by milling.

8. A centrifugal separator according to claim 1, wherein said outlets are evenly distributed around the periphery of the rotor.

9. A centrifugal separator according to claim 1, wherein said outlets are distributed around the periphery of the rotor at substantially the same axial position with regard to said rotary axis.

10. A centrifugal separator according to claim 1, wherein said outlets are substantially identical.

11. A centrifuge rotor for a centrifugal separator, wherein the rotor is arranged to be rotatable in a rotary direction around a rotary axis, the rotor including; a rotor wall, which defines an outer periphery of the rotor and encloses an inner space, at least an inlet, which extends through the rotor wall and permits feeding of a product to the inner space, and a number of outlets, which extend through the rotor wall and are arranged to permit intermittent discharge of a separated product from the inner space to an outer space outside the rotor, wherein said outlets are distributed around the periphery of the rotor, said number of outlets being uneven;

wherein the rotor includes a valve member, which is provided inside said outlets and arranged to be in a closed position, in which said discharge is prevented, and in an open position, respectively, in which said discharge is permitted;

wherein the valve member in the closed position extends around the rotor wall in such a way that a gap-like space is formed between the rotor wall and the valve member at the level of said outlets.

* * * * *